United States Patent [19]

Fisher

[11] 4,132,487

[45] Jan. 2, 1979

[54] KEYBOARD SWITCH

[75] Inventor: Robert P. Fisher, St. Paul, Minn.

[73] Assignee: Maxi-Switch Company, Minneapolis, Minn.

[21] Appl. No.: 796,864

[22] Filed: May 16, 1977

[51] Int. Cl.[2] ..... B41J 5/08

[52] U.S. Cl. ..... 400/479.1; 178/17 C; 200/1 B; 340/365 C

[58] Field of Search ..... 178/17 C; 197/98; 200/1 B, 159 R, DIG. 1; 235/145 R; 340/365 C; 361/288; 400/479.1, 479.2

[56] References Cited

U.S. PATENT DOCUMENTS

| | | | |
|---|---|---|---|
| 2,360,128 | 10/1944 | Hausler | 200/1 B |
| 3,797,630 | 3/1974 | Zilkha | 197/98 |
| 3,951,250 | 4/1976 | Pointon et al. | 197/98 |
| 3,965,399 | 6/1976 | Walker et al. | 361/288 |

*Primary Examiner*—Paul T. Sewell

*Attorney, Agent, or Firm*—Schroeder, Siegfried, Ryan, Vidas & Steffey

[57] ABSTRACT

This invention relates to a keyboard switch or push button transducer for use in keyboards which makes use of the advantages of resistive and capacitive methods of closure. The switch element is comprised of a resilient conductive element attached to a pad of compressible foam mounted on the end of a key plunger. When the push button or switch plunger is depressed, the switch element is brought into contact with conductive elements etched on a printed circuit board. One of the conductive elements has a coating of dielectric material thereon, and the other conductive element has a raised conductive surface to contact the conductive elastomer sheet prior to the contact with the dielectric material. The insulated area forms a capacitance between the elastomer sheet and the conductive element or metallic pad on the printed circuit board, and the other area of conductor element, being uninsulated, makes a resistive contact with the elastomer. This forms a series resistance capacitance switch capable of passing pulsed signals therethrough.

5 Claims, 2 Drawing Figures

KEYBOARD SWITCH

BACKGROUND OF INVENTION

1. Field of Invention

This invention relates to keyboard switches or push button type transducers for use in electronic circuits in which the key, when depressed, moves an elastomeric conducting element into contact with or into proximity with two conductive regions on a fixed member.

2. Prior Art

In keyboard switches of this type, the key normally carries or has associated therewith a striker member which when depressed by the key moves toward the conductive elements on the fixed member, usually a printed circuit board. The striker member may carry either a dielectric sheet backed by a conductive sheet, an elastomeric conductive element, or a resistive element generally of rigid construction and backed by a compressible mounting. Such transducers may provide a pure capacitive coupling between the conductive elements on the fixed member or a combination of a resistive capacitive coupling, or a pair of resistive couplings.

An example of the pure capacitive type transducer is shown in the patent to Frank A. Walker Jr., et al, U.S. Pat. No. 3,965,399, dated June 22, 1976 and entitled PUSH BUTTON CAPACITIVE TRANSDUCER. This patent teaches a special mounting of the striker having a deformable dielectric sheet and a conductive sheet thereon to insure uniform contact with the conductive elements for a uniform capacitive coupling upon operation. However, the physical size of the striker in a keyboard application is such as to limit the amount of capacitance developed, and the build up of a static charge with plunger operation requires more sophisticated electronic circuitry to separate valid switch closure signals from signals generated by the static charge and stray pick up signals between switches.

The patents to S. Zilkha U.S. Pat. No. 3,797,630, dated Mar. 19, 1974 and entitled KEYBOARD FOR ELECTRONIC CIRCUIT, and Peter Pointon et al U.S. Pat. No. 3,951,250, dated Apr. 20, 1976, and entitled CAPACITIVE KEY FOR ELECTRONIC CIRCUIT both show arrangements in which the striker member carries an elastomeric conductive member to contact conductive regions on a fixed member such as a printed circuit board. When the elastomer pad contacts the plates it closes the circuit and forms two capacitances with corresponding plates on the other side of the printed circuit board, the board itself acting as the dielectric. These two capacitances are connected in series thru the resistive path formed by the elastomeric conductor. In the Zilkha patent, the effects of static charge buildup on the elastomeric conductive striker can, in certain circumstances, cause erroneous operation. The Pointon et al patent shows various modifications of this keyboard switch in which the dielectric sheet over the fixed conductive elements has a conductive sheet or conductive regions positioned on the dielectric sheet and opposite the fixed conductive elements on the printed circuit board to be contacted by the striker. This arrangement is designed to reduce the electrostatic charge on the capacitive coupling between the conductive elements. The Pointon et al patent shows variations of this switch design in which the striker member carries a ceramic with dielectric therein to contact fixed conductive elements on the printed circuit board and it also shows a striker having a solid surface of resistive material backed by a foam mounting and contacting the dielectric on the conductive elements positioned on the printed circuit board. In the Pointon et al teaching, where the elastomeric conductive striker is used, the dielectric between the conductive elements or conductive areas is in itself a printed circuit board. The conductive elastomer bridges the metallic pads or conductors making a resistive coupling and this combination transfers the key closure signal that is obtained capacitively from a third plate on the opposite side of the printed circuit board. With this method, very small values of capacitive coupling is obtained. While this structure has the advantage of dissipating static charge that tends to be generated on the plunger or striker as it moves up and down, it results in a complex switch design and requires more sophisticated drive and detection circuitry.

SUMMARY OF INVENTION

This invention provides a keyboard switch or push button type transducer particularly adapted for use in a keyboard switch which combines the advantages of a resistive and capacitive methods of switch closure. The striker or switch element is comprised of a conductive elastomer sheet or member attached to a pad of compressible foam. This is mounted on the end of the key plunger. The plunger, when depressed, causes the elastomer on the striker to come into contact with two areas on a printed circuit board. One area is a conductive element etched on the printed circuit board and the second area is a conductive element etched on the printed circuit board to be coplaner with the first area and separated thereon. A coating of dielectric material is positioned over the second area. The combination of the dielectric material and conductive element of the second area forms a capacitance with the elastomeric conductive surface of the striker, and the first conductive element on the printed circuit board, which is uninsulated, makes a resistive contact with the elastomeric conductor of the striker. The two in combination form a series resistance-capacitance type switch which is capable of passing pulsed signals through the same or between the conductive elements. Such signals will then be processed to indicate key closure. In this construction, the amount of capacitance developed is maximized thereby permitting a simplier input and detection circuitry to be associated therewith. The resistive coupling provides a means for dissipating the static charge build up on a elastomeric conductive surface of the striker which might cause false signals to the electronic circuits and possibly damage the same. The physical configuration of the uninsulated conductive element is such that the surface thereof is raised some distance above the level of the capacitive plate. This eliminates a major problem of bounce or intermittent contact normally found in mechanical switches which might result in a switch signal. With the improved construction, any intermittent contact that may occur at the instant of closure takes place before a significant level of capacitance is reached, and, therefore, such closure will not be erroneously detected by the electronic detection circuit as a key closure.

It will therefore be seen that the simplified design of this transducer or keyboard switch will overcome the problems of stray signals caused by static charge and/or the intermittancy of mechanical contact. The improved design provides for conventional switch feel through the use of a foam pad in the plunger and provides a uniform, consistent and reliable output signal in an economical manner which may be utilized with simplified input and detection circuitry.

Figure 1:
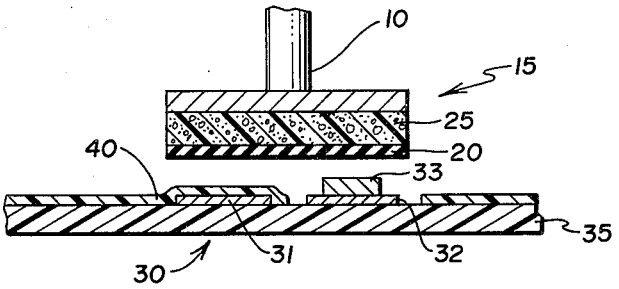
FIG. 1 is a diagramatic view in vertical section showing part of the striker element of the key together with part of the fixed cooperating structure on the electronic keyboard. In the drawing, for purposes of clarity, the thickness of some of the layers or components have been exaggerated.

In the drawings, the improved keyboard switch or transducer is shown diagramatically to show the arrangements of parts thereof. The switch plunger 10 can be mounted in a suitable frame for reciprocal movement and would have a key at one end of the same for depressing the plunger. The plunger would normally be spring biased to a raised position. A switch element or striker 15 is comprised of a conductive elastomer sheet 20 attached to a pad 25 of compressible foam and is suitably secured to the end of the plunger. The depression of the key would move the plunger and the striker toward and into contact with conductive elements, indicated generally at 30, mounted on a fixed member or printed circuit board, indicated at 35.

Figure 2:
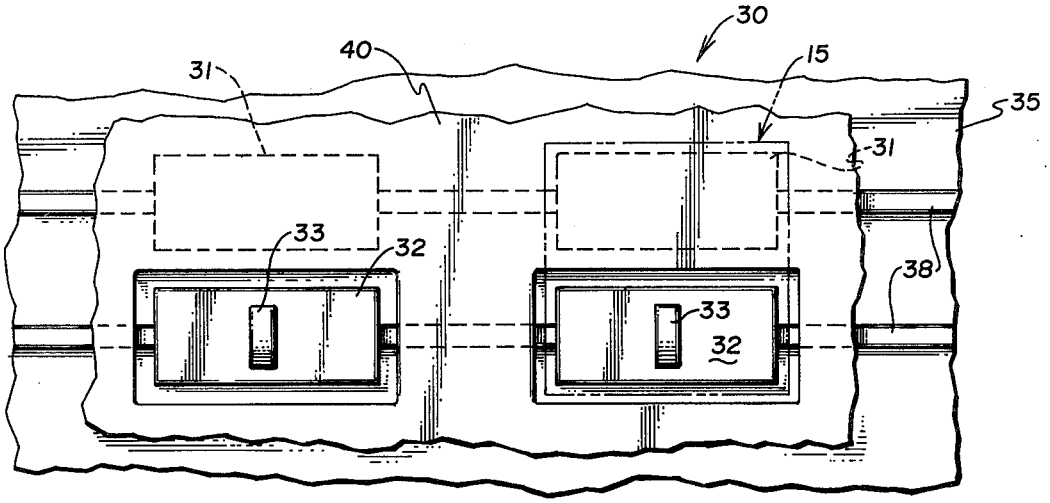
FIG. 2 is a diagramatic view of part of the electronic circuit board showing the relationship of the dielectric to the conductive elements.

As will be seen from the fragmentary portion of the circuit board 35 in FIG. 2, the conductive elements 30 are areas 31, 32 which are preferably etched on the printed circuit board as two coplaner areas and form metallized plates of good conductive material. These plates are conventionally from $\frac{1}{2}$ to $\frac{3}{4}$ of a mil in thickness. The conductive plate 31 has a covering of dielectric material 40 positioned over the same. The other plate 32 which is spaced therefrom has an additional conductive element 33 suitably attached thereto. In FIG. 2, the plates of conductive elements 31 and 32 are shown as suitably interconnected on a circuit board through etched conductors, indicated generally at 38. Rows of such spaced conductive elements suitably interconnected will normally be positioned on the surface of the circuit board. The covering of conductive material indicated at 40, would normally be applied to the entire surface of the printed circuit board with the uninsulated conductive elements being protected to be free of a dielectric coating 40. Thus, as shown in FIG. 2, the areas surrounding the conductive element 32, with the additional conductor member 33 thereon, will have no insulating or dielectric material applied thereto. The dielectric material forms a capacitance between the conductive elastomer 20 of the striker and the metallic plate 31 positioned on the circuit board. The other conductive element 32, being uninsulated, makes a resistive contact with the elastomer pad 20 on the striker of the plunger. This will form a series resistance-capacitance type switch which is capable of passing pulsed signals therethrough. Although FIG. 2 shows one embodiment or interconnection with conductors 38, it will be recognized that variations in the shape of the conductive elements and interconnecting conductors may occur.

The application of the dielectric material 40 to the circuit board and one of the pair of conductive elements may take varying forms. I have found that a dielectric in liquid state may be applied to the surface of the printed circuit board. The conductive elements which are to be uninsulated will be masked to prevent covering of the same with the dielectric material. The dielectric material is allowed to dry and will provide an insulating covering over the conductors and one of the metallic plates for each key position. Such a dielectric material may have a thickness in the order of 0.5 to 3 mils. The added conductor member 33 to be applied to the uninsulated metallic sheet on the circuit board may similarly take varying shapes or forms. I have found that an element having a coating of a good stable conductive material thereon can be applied through the conductive element 32 and secured to the circuit board to make a good electrical contact therewith. The thickness of the conductor is such as to raise the height of the uninsulated conductive surface above the insulated surface by a matter of 10 to 15 mils. It will be appreciated that other means of connecting a conductor member to the conductive plate on the printed circuit board may be employed. Similarly, the shape and thickness of the conductor member 33 to be added to the element 31 may be varied.

With this arrangement of parts, a resistive coupling is provided by contact of the uninsulated conductive element with the conductive elastomer to provide a means for dissipating static charges which build up on the plunger assembly and which could cause false signals or damage to the associated electronic circuits. Similarly, the physical configuration of the resistive plate is such that the contact is raised some distance above the level of the capacitive plate. This eliminates the major problem found in mechanical switches of contact intermittency. Upon depression of the plunger, the striker will engage the resistive contact first, allowing the conductive elastomer to deform around the same before the striker is brought into proximity with the dielectric material on the insulated contact or conductive element. With this arrangement of parts, any intermittent contact that may occur at the instant of closure takes place before significant level of capacitance is reached and therefore is not erroneously detected by the electronic circuit as a key closure.

In addition, the improved arrangement of parts permits the amount of capacitance developed to be maximized. With the increased capacitance change, the switch may be utilized with simplier drive and detection circuitry. The reason for this is that only a thin layer of dielectric exists between the conductive element 31 and the elastomer 20 thereby providing a maximum change of capacitance when the striker contacts the dielectric.

In considering this invention, it should be remembered that the disclosure is illustrative only and the scope of the invention should be determined by the appended claims.

I claim:

1. A push button transducer comprising, a reciprocal member, a resilient compressible foam pad positioned on one end of the reciprocal member, a conductive elastomer member mounted on said resilient pad, a pair of conductor elements separated by a gap and mounted on one side of a fixed member, a covering of dielectric material positioned over one of said conductor elements, and means for reciprocating the reciprocal member into bridging contact with said dielectric covered conductor element and said other conductor element to vary the resistance and capacitance coupling between the conductor elements, said one conductor element with the dielectric covering thereon having a thickness dimension less than a thickness dimension of the other conductor element to permit contact of the elastomer member with the other conductor element before the elastomer member contacts the dielectric covering.

2. The push button transducer of claim 1 in which the covering of dielectric material positioned over said one of said conductor elements covers the surface of said conductor element.

3. The push button transducer of claim 1 in which the fixed member is a printed circuit board with connections to said conductor elements.

4. The push button transducer of claim 3 in which the reciprocal member is a key plunger for a keyboard switch.

5. A keyboard comprising, a plurality of keys each carrying a conductive elastomer striker, each key having a foam backing behind the conductive elastomeric striker, a fixed member having a pair of spaced conductive elements on one side thereof for each key, said fixed member being a printed circuit board with said conductor elements etched thereon, said striker being movable by depression of a key associated therewith towards said conductive elements on the fixed member, and a dielectric coating covering one conductive element of each pair of each key, said conductive element with the dielectric covering of each pair having a height dimension which is less than the height dimension of the other conductive element of each pair with respect to the associated striker such that the striker contacts the other conductive element first upon depression to vary the resistive and capacitive coupling between the conductive elements, and means for coupling electrical signals between conductive elements.

* * * * *